US008986402B2

(12) United States Patent
Kelly

(10) Patent No.: US 8,986,402 B2
(45) Date of Patent: Mar. 24, 2015

(54) METHOD FOR CONTROLLING AND OPTIMIZING THE MANUFACTURE OF GASOLINE BLENDSTOCKS FOR BLENDING WITH AN ALCOHOL AS AN OXYGENATE

(71) Applicant: ExxonMobil Research and Engineering Company, Annandale, NJ (US)

(72) Inventor: Francis X. Kelly, Alexandria, VA (US)

(73) Assignee: ExxonMobil Research and Engineering Company, Annandale, NJ (US)

( * ) Notice: Subject to any disclaimer, the term of this patent is extended or adjusted under 35 U.S.C. 154(b) by 271 days.

(21) Appl. No.: 13/621,364

(22) Filed: Sep. 17, 2012

(65) Prior Publication Data

US 2014/0075831 A1 Mar. 20, 2014

(51) Int. Cl.

| | |
|---|---|
| ***C10L 1/18*** | (2006.01) |
| ***C10L 10/10*** | (2006.01) |
| ***C10L 1/02*** | (2006.01) |

(52) U.S. Cl.

CPC ..... *C10L 10/10* (2013.01); *C10L 2290/24* (2013.01); *C10L 1/023* (2013.01); *C10L 2290/562* (2013.01); *C10L 2290/58* (2013.01)

USPC ..... 44/451

(58) Field of Classification Search

CPC ..... C10L 1/023; C10L 1/1824; C10L 10/10; C10L 2290/24

USPC ..... 44/451

See application file for complete search history.

(56) References Cited

U.S. PATENT DOCUMENTS

| | | | | |
|---|---|---|---|---|
| 5,600,134 | A | 2/1997 | Ashe et al. | |
| 6,258,987 | B1 | 7/2001 | Schmidt et al. | |
| 2004/0123518 | A1* | 7/2004 | Eastman et al. | 44/446 |
| 2006/0162243 | A1* | 7/2006 | Wolf | 44/451 |
| 2009/0158824 | A1 | 6/2009 | Brown et al. | |
| 2010/0131247 | A1* | 5/2010 | Carpenter et al. | 703/2 |

FOREIGN PATENT DOCUMENTS

| | | | |
|---|---|---|---|
| JP | 2005-29761 | A | 2/2005 |
| JP | 2006-249309 | A | 9/2006 |
| JP | 2010-229336 | A | 10/2010 |

OTHER PUBLICATIONS

Anderson et al., "Octane Numbers of Ethanol- and Methanol-Gasoline Blends Estimated From Molar Concentrations", Energy Fuels, vol. 24, pp. 6576-6585 (2010).

Asian Clean Fuels Association, MTBE & Engine Performance, Aug. 16, 2005.

Anderson et al., "Octane Numbers of Ethanol-Gasoline Blends: Measurements and Novel Estimation Method From Molar Composition", SAE Technical Paper 2012-01-1274, 2012, doi: 10.4271/2012-01-1274.

* cited by examiner

*Primary Examiner* — Cephia D Toomer

(74) *Attorney, Agent, or Firm* — Malcolm D. Keen; Glenn T. Barrett; Andrew T. Ward

(57) ABSTRACT

A method for manufacturing an oxygenated gasoline-blend by blending a hydrocarbon Basestock for Oxygenate Blending (BOB) with an alcohol such as ethanol to a required octane specification first blends the BOB to an octane number, (RON+MON)/2 based on the octane sensitivity (RON−MON) of the BOB and the proportion of alcohol to be added to the BOB, such that when the BOB is blended with the specification proportion of alcohol to form the oxygenated gasoline blend, this blend will have the required octane specification. The blending of the BOB with the alcohol will typically be done at a location remote from that where the BOB is blended, e.g. at the product distribution terminal after being transported from the refinery by pipeline or tank car.

13 Claims, 1 Drawing Sheet

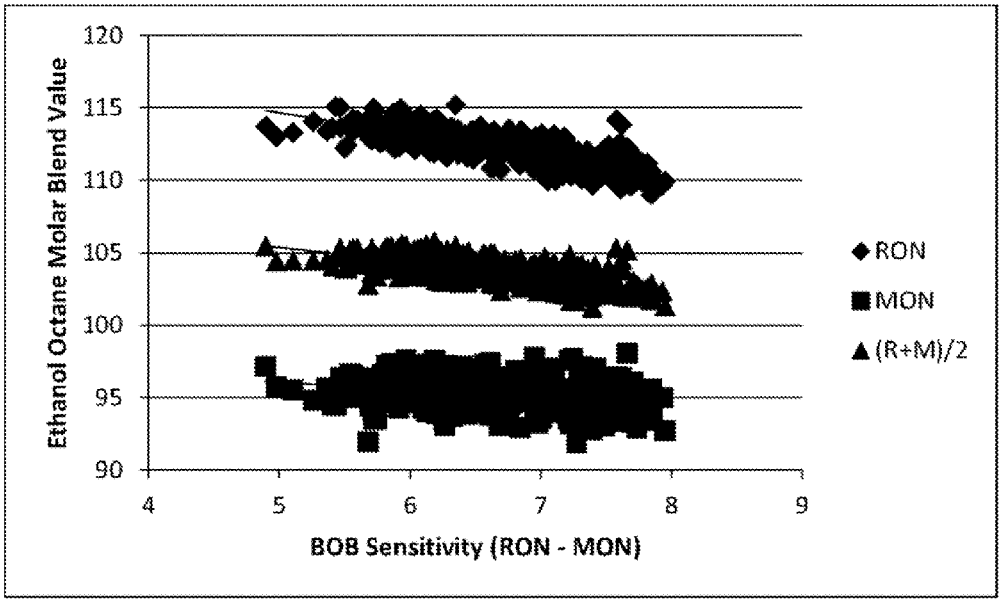
Ethanol Octane Molar Blend Value
120
115
110
105
100
95
90
4
5
6
7
8
9
BOB Sensitivity (RON - MON)
RON
MON
(R+M)/2

METHOD FOR CONTROLLING AND OPTIMIZING THE MANUFACTURE OF GASOLINE BLENDSTOCKS FOR BLENDING WITH AN ALCOHOL AS AN OXYGENATE

FIELD OF THE INVENTION

The present invention relates to a method for controlling and optimizing the manufacture of gasoline blendstocks for blending with an alcohol as an oxygenate.

BACKGROUND OF THE INVENTION

Conventional (oxygenate-free) mogas (gasoline sold at the pump for road use) has been largely replaced by ethanol-containing gasoline in the United States; Canada, Europe and other countries are also mandating the use of oxygenates in gasoline. Currently, alcohols are favored to supply the mandated levels of oxygen in the blended fuels as environmental problems have arisen with respect to other oxygenates such as ethers. Ethanol is the alcohol most frequently used in view of its economics and availability from agricultural sources.

As explained in U.S. Pat. No. 6,258,987 (Schmidt), the ethanol is not usually blended into the finished gasoline within the refinery because the ethanol is water soluble. As a consequence of this solubility, an ethanol-containing gasoline can undergo undesirable change if it comes in contact with water during transport through a distribution system, which may include pipelines, stationary storage tanks, rail cars, tank trucks, barges, ships and the like: absorbed or dissolved water will then be present as an undesirable contaminant in the gasoline. Alternatively, water can extract ethanol from the gasoline, thereby changing the chemical composition of the gasoline and negatively affecting the specification of the gasoline, possibly leading to regulatory violations since the government may require a certain oxygenate content in the gasoline sold at the pump. Government regulation in the U.S., for example, has until recently limited the oxygen content of gasoline to 4.0 wt. % while also requiring that reformulated gasolines contain at least 1.5 wt. % of oxygen, resulting in the gasoline known as E10 when ethanol is used as the oxygenate at nominally 10 vol %. More recent regulations propose a grade known as E15 for newer vehicles and other grades are also on sale, for example, E85, for use in multi-fuel engines.

In order to avoid contact with water as much as possible, ethanol-containing gasoline is usually manufactured by a multi-step process in which the ethanol is incorporated into the product at a point which is near the end of the distribution system, e.g. at the product distribution terminal, "at the rack". More specifically, gasoline which contains a water soluble alcohol such as ethanol, is generally manufactured by producing an unfinished and substantially hydrocarbon precursor subgrade or blendstock usually known as a Blendstock for Oxygenate Blending (BOB) at the refinery, transporting the BOB to a product terminal in the geographic area where the finished gasoline is to be distributed, and mixing the BOB with the desired amount of alcohol at the terminal.

As ethanol is typically blended at the distribution terminal and not at the refinery gasoline blend header, problems arise in the operation of the overall manufacturing and distribution process. Ethanol-free gasoline is typically produced within a refinery as a finished product which fully meets all necessary specifications for sale as an ethanol-free product. This finished gasoline can be manufactured to fit the required product specifications very precisely because analytical data for the product can be obtained during the manufacture (aka gasoline blending) process and used to control the blending process. As a consequence, manufacturing costs are kept to a minimum because expensive blendstocks are usually not wasted by exceeding specifications. Unfortunately, this type of precise manufacturing control is not possible for blending configurations where the final commercial grade ethanol-containing gasolines are prepared by mixing a non-ethanol containing subgrade blend manufactured at a refinery with ethanol at a location remote from the refinery.

Octane is a key gasoline specification which typically constrains production. The octane response (increase) when mixing ethanol and the BOB is not constant, but is dependent on the composition of the BOB. Limitations in the capability to predict the response of octane to ethanol addition increases production costs by reducing the capability to both optimize gasoline blend planning (including gasoline component purchases and sales) and to optimize gasoline production when using feedback from online octane engines to control the blending operation used for the BOB.

The general problem which therefore requires to be solved is the control of octane during the gasoline blending since the volume of ethanol in the finished product is governed by regulation. The process analyzers used to measure the properties of the gasoline produced during the blending process at the refinery report the octane of the BOB but not that of the final product blended with ethanol which is made at the remote distribution terminal. Hence the octane rating of the with-ethanol product must be inferred from the BOB octane and the blending operation at the refinery to make the BOB must target the octane sufficiently above specification in order to ensure that the final product as blended with ethanol at the terminal will conform to specification; this reflects imprecision in the capability to predict the octane "boost" due to the ethanol addition. In order to avoid "octane give-away" or the manufacture of a BOB which has an uneconomic and excessively high octane rating, it would obviously be desirable to develop an approach which improves the precision of the octane prediction so as to enable the BOB to be blended at an octane rating which enables the finished with-ethanol specification to be predictably and reliably achieved.

There are five general categories of existing approaches to estimate the effect of ethanol on octane: (1) assuming a constant (or proportional to BOB octane) octane boost due to the effect of the ethanol, (2) assuming a volumetric or molar blend value for ethanol octane, (3) measuring the ethanol effect during each blend (by measuring BOB and with-ethanol octane) and adjusting the BOB octane target accordingly, (4) spectroscopic methods to estimate the with-ethanol octane from the BOB spectrum (determined either online or offline), and (5) composition-based models for volumetric ethanol octane blend values. In the approach disclosed in U.S. patent application Ser. No. 13/101,580 (counterpart of PCT/US2012/036277, Kelly), the BOB is manufactured at the refinery site in accordance with an empirical relationship, valid for that refinery site under typical manufacturing conditions, between (i) a property value of the BOB stream, e.g. octane, as determined by an on-site online process analyzer, and (ii) the corresponding property value for the final gasoline stream when blended with the required proportion of oxygenate and measured by the specification mandated test method. U.S. Pat. No. 6,258,987, mentioned above discloses approach (3).

US Patent Application 2010/0131247 (Carpenter) proposes to model the BOB subgrade using spectroscopic measurements and associating the subgrade characteristics in the model to the properties of the finished oxygenate-containing gasoline, an example of approach (4) above. While the use of the chemometric models described in this application represents one way to assure compliance of the finished gasoline with specification, the development of the required, highly detailed models is itself time-consuming and possibly subject to error arising from misinterpretation and correlation between the properties of the finished gasoline and those of the BOB subgrade. Chemometric models such as this are typically sensitive to the hydrocarbon composition of the BOB, and therefore have a limited range of validity and need to be refitted for different compositional envelopes. Also, it is impractical to embed a chemometric model into the models normally used for refinery or gasoline blending optimization because of the enormous number of data points that have to be accommodated in the chemometric model if the optimization model is to extend over a reasonably broad scope of refinery operating conditions.

The use of composition based models for estimation of the ethanol effect as in approach (5) is found in JP 4624142 B2 (JP2006/249309 A, Tanaka/Cosmo Oil), JP 2010/0229336 A (Tanaka/Cosmo Oil) and JP 2005/029761 A, Watanabe/Nippon Oil).

A relationship between BOB composition and final octane is recognized by Anderson et al (Energy and Fuels 24, 6576-6585) and SAE Technical Paper 2012-01-1274) in demonstrating that ethanol octane blends by mole with BOB (hydrocarbon) octane and cites a potential dependence of the ethanol octane molar blend value on BOB isoparaffin content, consistent with approach 2.

SUMMARY OF THE INVENTION

In developing a technology for improving the predictability and precision of the final octane rating of the alcohol-containing blend from properties of the BOB, one consideration is that it would be desirable to utilize information about the properties of the BOB which need to be measured at the time the BOB is blended. It has now been found that this can be done using the measured sensitivity of the BOB—the difference between the Research and Motor octane numbers (RON and MON).

According to the present invention therefore, an alcohol-free hydrocarbon Basestock for Oxygenate Blending (BOB) which is to be blended with an alcohol to a required octane specification is manufactured by first, using an optimized BOB blend recipe formulated to provide a BOB octane (RON, MON, and/or (R+M)/2) which is intended, when the BOB is blended with the alcohol, to meet the BOB-alcohol blend octane specification; this blend recipe is based on the effect of BOB sensitivity (RON−MON) on the octane boost resulting from the addition of the alcohol. The BOB blend is controlled in this way according to an online octane measurement of the BOB and the measured sensitivity of the BOB so as to meet the required octane number for the BOB-alcohol blend. The final fuel blend is then made up by blending an alcohol with the BOB to form the gasoline-alcohol blend with the required octane specification.

While the blending of the BOB with the alcohol will typically be done at a location remote from that where the BOB is blended, e.g. at the product distribution terminal after being transported from the refinery by pipeline or tank car, it is possible to carry out both blending operations at one site, e.g. the refinery where the hydrocarbons making up the BOB are produced if the final product to be sold at the pump is close to the refinery.

The ability to blend the BOB to a lower octane determined by the octane sensitivity of the BOB to alcohol blending offers a potential for more favorable refinery blending operations by reducing the magnitude of octane give-way since the BOB octane requirement can be reduced in a predictive manner while still allowing on-specification alcohol blend to be produced. If the refinery produces conventional (non-oxygenated) gasoline grade in addition to the BOB grade, a further favorable effect on refinery octane can be achieved in the refinery gasoline pool by blending non-oxygenated gasoline to conform to its own characteristic first blend requirement while the BOB is blended to conform to a second but lower blend requirement which allows for the octane boost when the BOB is blended with the alcohol; in this case, the gasoline streams for the two grades which are of varying octane number are blended with the conventional gasoline receiving a higher proportion of blend components with higher octane sensitivity than the BOB grade. In this way, blending economics can be optimized between the two grades.

The method for manufacturing the BOB for blending with a pre-determined quantity of alcohol (typically set by regulation or contract requirement) to form the oxygenate/-BOB blend with a pre-determined octane specification (typically determined by marketing, regulation or contract requirement) by preparing a BOB to an initial BOB blend recipe, intended to meet the octane specifications after the addition of the alcohol, where the BOB octane requirements are determined based on the octane sensitivity (RON−MON) of the BOB and the proportion of alcohol which is to be added to the BOB to form the oxygenated blend. The blend recipe can then be adjusted in necessary so that the octane requirement for the blended BOB/alcohol is met. The octane specification is normally set by regulation, marketing requirements or contract, for example, the Anti-Knock Index/Pump Octane Number (AKI), (RON+MON)/2, which is common in the United States or the RON in Europe; MON is also a possibility if required.

The octane sensitivity, normally determined as a component of quality control on the BOB blending process, is carried out by measuring the Research Octane Number (RON) of the BOB, measuring the Motor Octane Number (MON) of the BOB, and from them calculating the octane sensitivity (RON−MON) of the BOB. The BOB is then blended to an octane number determined by the octane sensitivity (RON−MON) of the BOB such that upon blending with the pre-determined proportion of alcohol, the Pump Octane Number or Anti-Knock Index, (RON+MON)/2, of the alcohol/BOB blend conforms to the pre-determined octane specification.

DRAWING

The single FIGURE of the accompanying drawing is a graph showing the relationship of Ethanol Molar Blend Value with BOB Sensitivity (RON−MON).

DETAILED DESCRIPTION

The present method generates a model to predict and control the effect of ethanol and other alcohols on gasoline octane. For brevity and convenience the invention will be described below with specific reference to ethanol as the most widely used alcohol at the present time but it is more generally applicable to use with other alcohols such as butanol, especially in the form of biobutanol in view of the increasing interest in this blend component. Butanol tolerates water contamination better than ethanol, is less corrosive, has a higher vapor pressure and is capable of stabilizing gasoline-ethanol blends. The following description should therefore be taken to extend to alcohols other than ethanol.

Specifically, the present method assumes and combines the following concepts: (1) ethanol octane blends on a molar basis with hydrocarbon (BOB) octane, (2) the effective ethanol molar octane blend value is not constant but is dependent upon the composition of the BOB, and (3) the compositional dependency of the ethanol molar octane blend value can be modeled as a linear function of the BOB sensitivity (defined as RON minus MON). The required input to the model (BOB sensitivity) will always be available when measuring the RON and MON of the BOB are measured, as they are measured at the refinery blend header. Expressed mathematically:

$$\text{Mogas-ethanol octane}=\text{mol \% ethanol}\times\text{molar octane blend value}+\text{mol \% BOB}\times\text{BOB octane} \quad \text{[Eq. 1]},$$

where $$\text{Molar octane blend value(RON,MON,or road)}=a^*(\text{BOB RON}-\text{BOB MON})+b \quad \text{[Eq. 2]}$$

where a, b are determined by fitting available data. One advantage of this method is that the same parameters may be used over a wide range of BOB compositions, unlike the chemometric models which are valid only over a limited range.

While BOB molecular weight is not readily available on most gasoline blends, 18.9 mol % is an adequate approximate value to represent 10 vol % denatured ethanol in the final mogas-ethanol blend which is to be marketed. For convenience and brevity, the 10 vol % ethanol blend, known as E10 will be assumed for purposes of this description to be the relevant final product but other blends permitted or required by regulation or contract such as, for example, E15 (15 vol % ethanol), E25 (25 vol % ethanol), E30 (30 vol % ethanol) and other oxygenated blends e.g. with butanol may also be produced by the present blending method. References to E10 should therefore be taken to imply that the same methodology may be applied also to such other blends and blending operations with the appropriate and necessary changes in the oxygenate blend components and blending parameters.

Assuming a constant value for the mol % ethanol which will typically be the case (regulations or contract requirements may require a specified amount of oxygenate (added as ethanol) to be blended or routine refinery and marketing practice settles on a fixed ethanol amount), equations 1 and 2 above can be combined into a simple form easily embedded in both online and offline applications:

$$\text{Mogas-ethanol octane}=c1\times\text{BOB RON}+c2\times\text{BOB MON}+c3 \quad \text{[Eq. 3]}$$

where c1, c2, c3 are determined based upon the a and b parameters fitted for Equation 2.

The FIGURE shows the linear dependence of the ethanol molar octane blend values with BOB sensitivity, using octane data collected from a major refinery.

The determination of the BOB RON and MON may be made by the standard test methods, RON by ASTM D2699 and MON by ASTM D2700 or by equivalent laboratory methods using either the instantaneous value or the FPAPV (Flow Proportioned Average Property Value (ASTM D6624) of the ethanol-free BOB blendstock passing through the refinery blend header, as described in ASTM D2885. For the purposes of blending up the refinery BOB, an online octane analyzer such as a test engine may be used although the determination and certification of the final blended ethanol-BOB octane will be made by the test method mandated by the specification such as ASTM D2699/D2700, that is, by an approved regulatory test method, a contractually required test method or by means of the modeling technique described in U.S. patent application Ser. No. 13/101,580.

The measurements may be extended over a period of time and a sufficient number of samples of the BOB and the final blend with ethanol to determine the variability of the mathematical relationship. As described in U.S. patent application Ser. No. 13/101,580, statistical calculation of the time/sample variation as the standard deviation a of the BOB and final blend octane ratings may be used to assure quality control of the blending operation with an adequate safety margin superimposed upon the BOB octane to provide an adequate level of confidence for the sale and certification of the final blended product. This safety margin is calculated based upon this standard deviation in such a way as to ensure a prescribed confidence level (e.g. 95%) that the final blended product is on-specification when determined by the corresponding primary test method i.e. the mandated test method, after the BOB has been blended with ethanol at the distant terminal and when the inferred property value of the alcohol blend is at the safety margin. One of the advantages of the present blending control, as described below, is that the required safety margin may be reduced while still maintaining an adequate margin of safety for the final product certification.

Examples of online octane measurement equipment include the Waukesha CFR™ F1/F2 octane engine, Core Laboratories Model 8200 octane analyzer which is mounted directly to a CFR engine and includes accessories and input/outputs for on-line analysis and the IOAS—Integrated Octane Analysis System also from Core Laboratories of Houston, Tex. The recognized online measurement protocol is ASTM D2885.

In operation at the refinery, the determination of the BOB octane performance (RON, MON) can be determined as follows:

a. Step 1: Collect Octane Data from prior batches:

BOB RON and MON (can be from either ASTM D2699/D2700 or equivalent laboratory octane determination, or from an online (e.g. ASTM D2885) FPAPV octane determination, and Corresponding to each of the BOBs, the RON and MON of the BOB-ethanol blends (e.g. E10 for 10% ethanol or other blend ratio)

The actual or nominal vol % ethanol for each batch b. Step 2: Screen data for validity/exclude any invalid data points (e.g. mis-recorded values).

c. Step 3: Calculate the BOB sensitivity for each batch (RON minus RON)

d. Step 4: Convert the vol % ethanol to a mol % equivalent (or an approximation if MW and density not available for the BOBs); e.g. 18.9 mol % for E10 e. Step 5: Calculate a molar RON and MON blend value for ethanol for each of the batches as follows from the Blend Value (BV) of the ethanol:

$$E10\text{RON}=\text{mol \% BOB}\times\text{RON(BOB)}+\text{mol \% ethanol}\times\text{RONBV}$$

Rearranging (for 18.9 mol % ethanol):

$$\text{RONBV(ethanol)}=[E10\text{RON}-81.1\%\times\text{RON(BOB)}]/18.9\%$$

Calculate the MONBV for ethanol in the same manner from the MONBV (ethanol)

f. Step 6: Using the full validated data set, regress the RONBV and the MONBV vs. the BOB sensitivity to get an equations of the following form:

$$\text{RONBV}=a\times\text{BOB sensitivity}+b$$

$$\text{MONBV}=c\times\text{BOB sensitivity}+d$$

g. Step 7: Embed equations from Step 6 into the equations in Step 5, and expand to convert BOB sensitivity to RON (BOB)−MON (BOB), resulting in equations of the following form:

$$E10RON=c1+c2\times RON(BOB)+c3\times MON(BOB)$$

$$E10MON=d1+d2\times RON(BOB)+d3\times MON(BOB)$$

h. Step 8: Embed the equations from Step 7 in applications, including but not limited to: (a) refinery-wide optimization models (e.g. LPs), (b) gasoline blend recipe optimization models (either single or multi-period), and (c) online blend control systems (to convert online BOB RON and MON measurements to the corresponding with-ethanol octane values)—in this case, these calculated with-ethanol octane values can be used for quality certification in accordance with the method described in U.S. patent application Ser. No. 13/101,580. In each case, the values of the coefficients a, b, c and d will be determined by fitting to available data One possible method for validating the octane data in Step 2 above is to apply the Western Electric rules (the decision rules used in statistical process control, for detecting non-random conditions on control charts[1]) to the periodic validation check. Satisfying the control chart rules can be interpreted as an indication that the model remains fit for use. Violations of these control chart rules typically include: (a) a single observation larger than three times the standard deviation of the established values; (b) two of three consecutive observations being larger than two times the standard deviation and having the same algebraic sign; (c) four of five consecutive observations being larger than one standard deviation and having the same sign; and (d) nine consecutive observations with the same sign. Alternatively, validation of the method can be done using control charting techniques as set out in ASTM D6299.

[1] Available in the *Statistical Quality Control Handbook*. (1 ed.), Indianapolis, Ind.: Western Electric Co., OCLC 33858387, © Western Electric Company (1956).

Advantages of the present method include improved precision of the with-ethanol octane prediction compared to the conventional blending methods (1) and (2) above, enabling reduced product quality giveaway, more optimal blend recipe generation and gasoline component utilization as well as a more accurate assessment of the value of potential gasoline component imports.

The standard deviation of the measured road ((RON+MON)/2) octane boost with 10 vol % ethanol for 87 road octane grade mogas over an experimental period at a major refinery was 0.20, representing the precision of method (1) in which a constant value is assumed for the octane boost from the ethanol. The present method improves the predictive capability of the with-ethanol octane value, reducing the standard deviation for the predicted (R+M)/2 vs. measured value to 0.13. For reference, the published ASTM reproducibility and repeatability for (R+M)/2 are 0.6 and 0.2 respectively, corresponding to measurement standard deviations of 0.22 and 0.07 (under reproducibility and repeatability conditions, respectively; refinery lab site precisions typically lie between the reproducibility and repeatability values). Hence, the predictive capability of the with-ethanol octane can move closer to the measurement capability with the present method. A smaller standard deviation allows shifting the operating target for octane closer to the specification value, reducing the cost of octane giveaway. Improved precision also supports online certification of octane using a model-based extension to online BOB octane determination by ASTM D2885, as described in U.S. patent application Ser. No. 13/101,580.

The addition of ethanol results in a significant increase in the road octane blend (the increase is less with butanol) and this increase is related to the octane sensitivity of the BOB: the BOBs with a lower sensitivity receive a greater octane boost from the same proportion of ethanol than the more sensitive blendstocks. In one refinery it was found that the BOB (R+M)/2 octane requirements decrease by about 0.2 ON per 1 number decrease in BOB sensitivity for E10 gasoline with a minimum 87 (R+M)/2 specification; these decreases in BOB octane, which have been found to be robust across a range of BOB compositions, can be effectively used to generate more favorable refinery economics. Olefins and aromatics are well known octane boosters but contribute to greater sensitivity; it was found that when the proportions of these components in a refinery BOB were reduced as a result of changes in refinery operations, the increase in road octane accruing from the ethanol addition was greater. If conventional (non-oxygenated) gasoline is also produced at the refinery, there is an opportunity to reduce the overall hydrocarbon pool octane requirement by diverting the high-sensitivity molecules, e.g. olefins, aromatics, to the conventional (non-oxygenated) grades. The conventional grades do not receive the octane boost from the added oxygenate and therefore benefit from the presence of the more highly sensitive, high octane blend components; at the same time, the octane of the oxygenated blends is given a proportionately greater boost by the addition of the oxygenate to the less sensitive BOB. This observation also favors the use of paraffins in the BOB since these have lower octane sensitivity. By effectively exploiting this phenomenon, decision making for refinery blend component imports and exports can be improved and more detailed preparations made for refinery turnarounds, e.g. when a catalytic cracking (FCC) unit is under a turnaround and olefins are less available.

In one example of making use of this effect in refinery optimization, the refinery will produce a BOB which is sent out for remote oxygenate blending at the terminal and a separate blended gasoline for sale as a conventional (non-oxygenated) product. The blending operations at the refinery using the normal refinery blendstocks (e.g. virgin naphtha, reformate, alkylate, FCC cracked gasoline, hydrocracked naphtha) are diverted to the blending of the two gasoline product grades with the proportion of the blend components with higher octane sensitivity such as aromatic stocks e.g. reformate, olefinic FCC naphtha, blended into the conventional gasoline being adjusted to be higher than in the blended BOB. The conventional gasoline is, of course, blended to conform to the final blend requirement for sale or use (with any octane additive, if permitted) while the BOB is blended to the octane inferred from the oxygenate blend model, e.g. as described in U.S. application Ser. No. 13/101,580, so that when the oxygenate is added at the terminal, the marketed product will conform to regulatory or contractual requirements.

The present method can, unlike approaches (3) and (4) above, be used in offline planning/scheduling/optimization tools, and, unlike approach (3) is not unduly influenced by the effect of test method imprecision on single measurement results of the BOB and with-ethanol octane values. Also, while one possible implementation of approach (3) is to directly inject ethanol into the BOB stream entering the process analyzers controlling the BOB blending, the present method eliminates the high cost associated with the installation and operation of such a facility. Likewise, an approach to estimating the with-ethanol octane which is dependent upon direct octane measurements during each blend as in approaches (3) and (4) cannot readily be used for offline planning, scheduling, and component optimization.

This present method exploits the use of already-existing equipment in the refinery (octane engines) to directly characterize the BOB octane instead of relying on an inferential measurement of the octane such as spectroscopic methods as in approach (4). Hence, the invention directly uses a direct measurement of the BOB octane, which does not require a mapping between a spectrum and an inferred octane. The model inputs are dependent solely on the BOB RON and MON determinations, and do not require additional measurements unlike approaches (3), (4) and (5).

Relying on the BOB sensitivity (RON−MON) to represent the compositional dependency of the ethanol octane blend value eliminates the need for both online compositional analysis (required for approach (5) and developing a compositional-based model. Compositional data required for approach (5), is typically not available to either online or offline applications.

Finally, the present method invention enables the use of a single model in both offline and online applications to be used across planning/scheduling/blending and component evaluation.

The invention claimed is:

1. A method for manufacturing a hydrocarbon Basestock for Oxygenate Blending (BOB) to be blended with an alcohol to a required BOB-alcohol blend octane specification, which comprises:

determining an octane sensitivity (Research Octane Number (RON)−Motor Octane Number (MON)) of a BOB;

determining a relationship between the octane of the BOB and a required octane number of a BOB-alcohol blend, wherein said relationship is based upon the effect of BOB sensitivity on the octane boost resulting from the addition of alcohol to the BOB;

formulating a blend recipe for a BOB, wherein the blend recipe is formulated to provide a BOB octane (RON, MON, and/or (R+M)/2) which will meet required octane specification(s) of a BOB-alcohol blend, and wherein the blend recipe is based upon the relationship between the octane of the BOB and the required octane number of the BOB-alcohol blend; and blending the BOB in accordance with the blend recipe.

2. The method of claim 1 further comprising blending the BOB with an alcohol to form a BOB-alcohol blend conforming to required octane specification(s).

3. The method of claim 2 wherein the blending of the BOB with the alcohol is carried out at a location remote from the location where the BOB is blended.

4. The method of claim 1 wherein the relationship between the octane of the BOB and the octane number of a BOB-alcohol blend is based upon the effect of BOB sensitivity on the octane boost resulting from the addition of alcohol to the BOB and the proportion of alcohol to be added to the BOB.

5. The method of claim 1 wherein the relationship between the octane of the BOB and the octane number of a BOB-alcohol blend is such that the BOB-alcohol blend octane number is decreased by up to 0.2 numbers per 1 number decrease in the octane sensitivity of the BOB.

6. The method of claim 2 wherein the alcohol is ethanol.

7. The method of claim 6 wherein the BOB is blended with ethanol to formulate a blended product comprising 10 volume percent ethanol.

8. The method of claim 7 wherein the BOB is blended with ethanol to formulate a blended product comprising 15 vol percent ethanol.

9. New The method of claim 1 wherein the required octane specification of the BOB-alcohol blend is the Anti-Knock Index/Pump Octane Number, (RON+MON)/2, of the blend.

10. A method of controlling the manufacture of a petroleum refinery gasoline pool comprising (i) a first grade which is a non-oxygenated gasoline grade blended to conform to a first blend octane requirement and (ii) a second grade which is a hydrocarbon Blendstock for Oxygenate Blending (BOB) blended to confirm to a second blend octane requirement lower than the first grade such that when the BOB is blended with a required amount of alcohol it meets an octane requirement for a BOB-alcohol blend, which method comprises:

blending refinery gasoline streams of varying octane number for the first and second grades with the first grade receiving a higher proportion of blend components with higher octane sensitivity than the second grade.

11. A method according to claim 10 wherein the second grade is formulated according to the following steps:

determining an octane sensitivity (Research Octane Number (RON)−Motor Octane Number (MON)) of a BOB;

determining a relationship between the octane of the BOB and a required octane number of a BOB-alcohol blend, wherein said relationship is based upon the effect of BOB sensitivity on the octane boost resulting from the addition of alcohol to the BOB;

formulating a blend recipe for a BOB, wherein the blend recipe is formulated to provide a BOB octane (RON MON and/or (R+M)/2 which will meet required octane specification(s) of a BOB-alcohol blend, and wherein the blend recipe is based upon the relationship between octane of the BOB and the required octane number of the BOB-alcohol blend; and blending the BOB in accordance with the blend recipe.

12. A method according to claim 10 in which the blend components with higher octane sensitivity include olefins and/or aromatics.

13. A method according to claim 11 in which the second grade comprises a blend including iso-paraffins.

* * * * *